US012698693B2

(12) United States Patent
Gunasekaran et al.

(10) Patent No.: US 12,698,693 B2
(45) Date of Patent: Aug. 4, 2026

(54) BIASING PISTON BASED EQUIFLOW ROV FOR PREVENTING WELL KICK OFF ISSUE

(71) Applicant: Halliburton Energy Services, Inc., Houston, TX (US)

(72) Inventors: Mohan Gunasekaran, Dhahran (SA); Ibrahim El Mallawany, Dharan (SA); Eddie Perez, Carrollton, TX (US); Luis Herrera-Cruz, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/010,421

(22) Filed: Jan. 6, 2025

(65) Prior Publication Data

US 2026/0193958 A1 Jul. 9, 2026

(51) Int. Cl.
*E21B 34/10* (2006.01)
*E21B 23/03* (2006.01)

(52) U.S. Cl.
CPC ..... *E21B 34/103* (2013.01); *E21B 23/03* (2013.01); *E21B 2200/06* (2020.05)

(58) Field of Classification Search
CPC ..... E21B 34/103; E21B 23/03; E21B 2200/06
See application file for complete search history.

(56) References Cited

U.S. PATENT DOCUMENTS 4,324,293 A * 4/1982 Hushbeck ..... E21B 49/001 166/324
7,201,232 B2 * 4/2007 Turner ..... E21B 43/12 166/329
7,775,283 B2 8/2010 Coronado et al.
8,757,273 B2 * 6/2014 Themig ..... E21B 43/26 137/500
8,807,215 B2 8/2014 Holderman et al.
9,206,669 B2 12/2015 Holderman
10,030,474 B2 * 7/2018 Themig ..... E21B 34/102
10,612,346 B2 * 4/2020 Ross ..... E21B 34/103
10,704,362 B2 * 7/2020 Themig ..... E21B 43/26
11,041,360 B2 6/2021 Penno et al.
11,066,909 B2 7/2021 Yin et al.
2005/0001427 A1 1/2005 Liew
2009/0151925 A1 6/2009 Richards et al.
(Continued)

FOREIGN PATENT DOCUMENTS

WO 2023122826 7/2023

OTHER PUBLICATIONS

"PCTUS2024022661 International Search Report and Written Opinion", Jul. 22, 2024, 11 pages.
(Continued)

*Primary Examiner* — Steven A MacDonald
(74) *Attorney, Agent, or Firm* — DeLizio, Peacock, Lewin and Guerra, LLP

(57) ABSTRACT

Implementations of a system, an apparatus, and a method are disclosed herein. In one implementation, a system configured for use in a wellbore drilled through one or more subsurface formations comprises a tubing string including one or more tubulars, a sliding side door (SSD) sleeve configured to move between an open position and a closed position, at least one snap ring, and a pressure-biased tubular, wherein the pressure-biased tubular and the SSD sleeve are coupled via the at least one snap ring.

20 Claims, 7 Drawing Sheets

(56) References Cited

U.S. PATENT DOCUMENTS

| | | | | |
|---|---|---|---|---|
| 2011/0100643 | A1* | 5/2011 | Themig | E21B 34/10 166/321 |
| 2013/0000740 | A1 | 1/2013 | Velt | |
| 2013/0056220 | A1* | 3/2013 | Sommers | E21B 34/102 166/334.1 |
| 2013/0284452 | A1 | 10/2013 | Franklin et al. | |
| 2014/0034308 | A1 | 2/2014 | Holderman et al. | |
| 2014/0060803 | A1 | 3/2014 | Gano | |
| 2014/0246208 | A1* | 9/2014 | Themig | E21B 43/26 166/321 |
| 2014/0246209 | A1* | 9/2014 | Themig | E21B 34/142 166/194 |
| 2016/0273287 | A1 | 9/2016 | Scott et al. | |
| 2018/0080590 | A1 | 3/2018 | Mckay | |
| 2018/0334882 | A1 | 11/2018 | Brandsdal | |
| 2018/0363420 | A1* | 12/2018 | Ross | E21B 34/14 |
| 2019/0136665 | A1* | 5/2019 | Themig | E21B 43/26 |
| 2019/0151925 | A1 | 5/2019 | Werke | |
| 2021/0324715 | A1 | 10/2021 | Yin et al. | |
| 2024/0117718 | A1 | 4/2024 | El Mallawany et al. | |
| 2024/0392651 | A1 | 11/2024 | El Mallawany et al. | |

OTHER PUBLICATIONS

"U.S. Appl. No. 18/602,376 Office Action", Dec. 17, 2025, 15 pages.
"PCT Application No. PCT/US2025/013284 International Search Report and Written Opinion", Sep. 29, 2025, 10 pages.
"U.S. Appl. No. 18/602,376 Office Action", Jun. 18, 2025, 19 pages.

* cited by examiner

BIASING PISTON BASED EQUIFLOW ROV FOR PREVENTING WELL KICK OFF ISSUE

TECHNICAL FIELD

The disclosure generally relates to wellbores formed in subsurface formations, and in particular, to pressure-sealing inflow control devices.

BACKGROUND

Traditional remotely operated valve (ROV) designs may allow pressure sealing from the tubing to the annulus but not vice versa. Tubing-to-annulus pressure sealing may not be sufficient in certain well conditions. For example, tubing-to-annulus pressure seals of traditional ROVs may not provide a sufficient seal during a kick or other fluid influx events in the well. However, annulus-to-tubing pressure sealing may be useful in preventing well kicks and other fluid influx events from entering a well.

BRIEF DESCRIPTION OF THE DRAWINGS

Implementations of the disclosure may be better understood by referencing the accompanying drawings.

FIGS. 1-7 and the operations described herein are examples meant to aid in understanding example implementations and should not be used to limit the potential implementations or limit the scope of the claims. Some implementations may perform additional operations, fewer operations, operations in parallel or in a different order, and some operations differently.

The description that follows includes example systems, methods, techniques, and program flows that embody implementations of the disclosure. However, it is understood that this disclosure may be practiced without these specific details. In other instances, well-known instruction instances, protocols, structures, and techniques have not been shown in detail in order not to obfuscate the description.

DESCRIPTION

Example implementations may utilize a biasing piston along with an existing SSD sleeve in the ROV design as two separate pieces connected by a snap ring. This two-piece ROV design may be used in addition to an existing ball and seat-based tubing-to-annulus sealing design and its associated features. The biasing piston along with SSD sleeve may be in a closed position initially which may seal the flow ports into the valve and enable annulus-to-tubing pressure sealing. This may provide well isolation if well kick off issues arise during run-in.

During run-in into the well, the two-piece ROV design may include the two sleeves comprising the biasing piston and SSD sleeve connected via the snap ring. At a later stage when the well is ready to set the packer, the biasing piston may be opened remotely via the application of tubing pressure rather than using a downhole tool. Once opened, the snap ring may snap into a female profile of a bottom sub, enabling the separation of both sleeves and locking the biasing piston in place.

The use of tubing pressure to open the biasing piston and uncover the flow ports into the SSD sleeve may enable annulus-to-tubing communication without any costly intervention. The combination of the existing ROV design with the inclusion of the biasing piston may also include features such as the snap ring and one or more shear pins, etc. These features may enable the ROV to disconnect the SSD flow tube and biasing piston as well as lock the biasing piston in place when opening the valve. Some implementations of the ROV may be used as an inflow control device (ICD). While some ICDs may include washpipe-free features, the ROV design described herein may plug (or seal) in both the annulus-to-tubing and tubing-to-annulus directions and remotely open with applied pressure.

Example Illustrations

Figure 1:
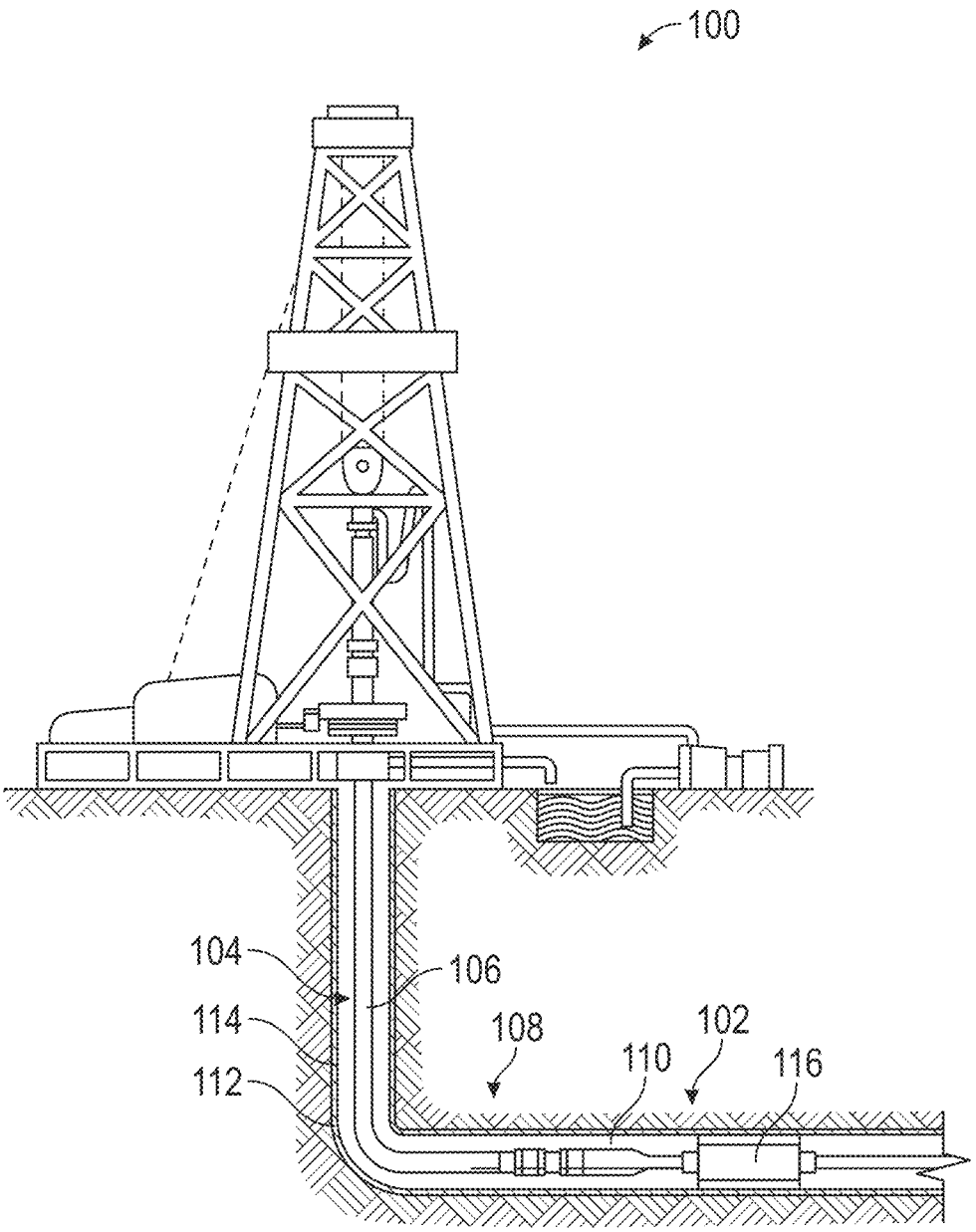
FIG. 1 is an illustration depicting an example operational environment for a wellbore completion system, according to some implementations.

An example well completions system is now described. FIG. 1 is an illustration depicting an example operational environment for a wellbore completion system, according to some implementations. As illustrated, the wellbore completion system 100 may include a lower completion assembly 102 that is run into a wellbore 104 via a downhole tubular 106 or other suitable conveyance. For example, some implementations of the downhole tubular 106 may include one or more joints of tubing as part of a tubing string. The lower completion assembly 102 may include at least one flow regulating system 108 for controlling fluid flow between an annulus 110 of the wellbore 104 and a central bore of the downhole tubular 106. As illustrated, the annulus 110 may be formed between the downhole tubular 106 and a casing 112 cemented against a wellbore wall 114. In some implementations, the annulus 110 may be formed between the downhole tubular 106 and the wellbore wall 114. Further, the lower completion assembly 102 may include a packer assembly 116, a latch subassembly, or any other suitable assembly.

Once the lower completion assembly 102 is positioned at a desired location in the wellbore 104, fluid may be pumped through the downhole tubular 106 toward the packer assembly 116. The pressure inside the tubular may increase to a setting pressure for actuating the packer assembly 116. Additionally, the setting pressure in the downhole tubular 106 may actuate the flow regulating system 108 such that the flow regulating system 108 allows open fluid flow between the annulus 110 and the downhole tubular 106. As such, fluids may flow openly through the flow regulating system 108 during production operations and/or injection.

Figure 2:
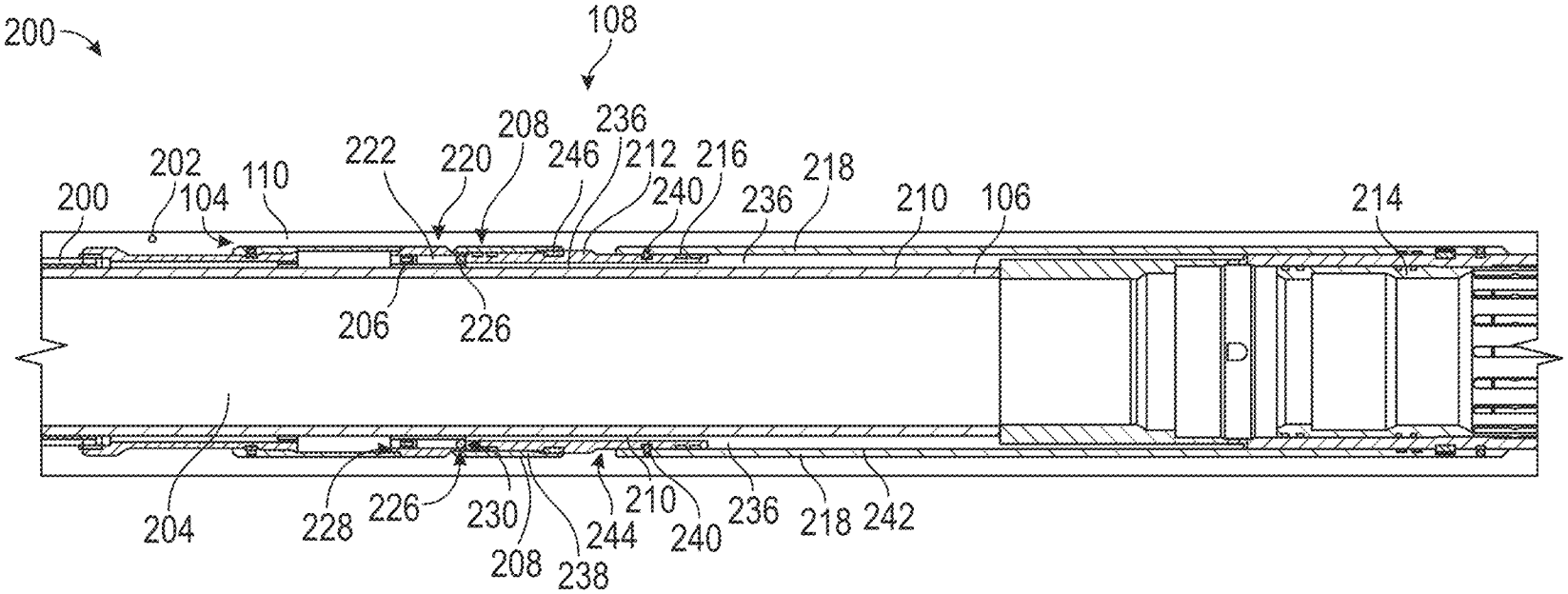
FIG. 2 is a longitudinal section depicting a traditional flow regulating system coupled to a tubular that is run-in-hole during an example completions operation.

FIG. 2 is a longitudinal section depicting a traditional flow regulating system coupled to a tubular that is run-in-hole during an example completions operation. FIG. 2 includes the wellbore 104, the downhole tubular 106, the flow regulating system 108, the annulus 110, one or more screens 200, debris 202, a central bore 204, an inflow control device nozzle 206, a washpipe free feature 208, a radially outer surface 210, a piston 212, a sliding sleeve door 214, an O-ring 216, a flow shroud 218, a housing 220, a nozzle chamber 222, a ball 226, a first end 228, a second end 230, a piston chamber 236, a radially inner surface 238, shear pins 240, a radially inner surface 242, a gap 244, and a locking feature 246. In some implementations, the one or more screens 200 may include one or more sand screens. The flow regulating system 108 may include various components for controlling the fluid flow between the annulus 110 and the downhole tubular 106. For example, as illustrated, the flow regulating system 108 may include the one or more screens 200 disposed about the downhole tubular 106. The screens 200 may be configured to filter debris 202 (e.g., as gravel, sand, and other particulate matter) out of the fluid flowing into the central bore 204 of the downhole tubular 106 from the annulus 110, as debris 202 in the downhole tubular 106 may adversely affect production operations.

Further, the flow regulating system 108 may include the inflow control device (ICD) nozzle 206, disposed in a flow path between the one or more screens 200 and the central bore 204 of the downhole tubular 106, as well as a washpipe free feature 208 disposed in the flow path between the inflow control device nozzle 206 and the central bore 204 of the downhole tubular 106. The inflow control device nozzle 206 and the washpipe free feature 208 may be secured to a radially outer surface 210 of the downhole tubular 106. As illustrated, the inflow control device nozzle 206 may be disposed within a housing 220 secured to the radially outer surface 210 of the downhole tubular 106. In particular, the inflow control device nozzle 206 may be disposed within a nozzle chamber 222 formed in a portion of the housing 220. Further, as set forth in greater detail below, a ball 226 of the washpipe free feature 208 may also be disposed within the nozzle chamber 222. The nozzle chamber 222 may extend axially through the housing 220. A first end 228 of the nozzle chamber 222 may be in fluidic communication with an annulus 110 of the wellbore 104, and a second end 230 of the nozzle chamber 222 may be in fluid communication with the central bore 204 of the downhole tubular 106.

The flow regulating system 108 may include various tubular portions disposed about the radially outer surface 210 of the downhole tubular 106. For example, as illustrated, the flow regulating system 108 may include the nozzle chamber 222 secured to the radially outer surface 210 of the downhole tubular 106. The piston 212 may be secured to the flow shroud 218 via the shear pins 240. Further, the piston 212 may be radially offset from the radially outer surface 210 of the downhole tubular 106 to form a piston chamber 236. That is, at least a portion of the piston chamber 236 may be formed in the space between the radially outer surface 210 of the downhole tubular 106 and a radially inner surface 238 of the piston 212 of the flow regulating system 108.

The flow shroud 218 may be disposed between the piston 212 and the sliding sleeve door 214, which is set forth in greater detail below. As illustrated, the flow shroud 218 may also be radially offset from a radially outer surface 210 of the downhole tubular 106 to further define the piston chamber 236. That is, an additional portion of the piston chamber 236 may be formed in the space between the radially outer surface 210 of the downhole tubular 106 and the radially inner surface 242 of the flow shroud 218. Moreover, the flow shroud 218 may be axially offset from the piston 212 to form a gap 244. As set forth in greater detail below, the gap 244 may be configured to receive a locking feature 246 of the flow regulating system 108. Alternatively, the flow shroud 218 may be configured to contact the piston 212, and the piston 212, the flow shroud 218, or some combination thereof may instead include a recess configured to receive the locking feature 246.

Moreover, the washpipe free feature 208 may include the piston 212, the piston 212 disposed at least partially within the piston chamber 236. Further, the piston 212 may be disposed in a run-in position as the lower completion assembly 102 is run into the wellbore 104. In the run-in position, the washpipe free feature 208 may be configured to permit fluid flow from the annulus 110 to the downhole tubular 106 while restraining fluid flow from the downhole tubular 106 to the annulus 110. This may be referred to as a tubing-to-annulus seal. However, after the lower completion assembly 102 is positioned at a desired location in the wellbore 104 and the pressure inside the tubular is increased to the setting pressure, a pressure differential in the washpipe free feature 208 may shift the piston 212 to an open position. Once an initial flow back from annulus to tubing occurs, each ball 226 may fall out of each respective nozzle chamber 222 which may allow the fluid to flow through the washpipe free feature 208 in both directions.

The washpipe free feature 208 may assist in setting the packer assembly. For example, the lower completion assembly 102 may be run-in-hole with the downhole tubular 106 plugged from below. As the lower completion assembly 102 is run-in-hole, wellbore fluid may flow into the tubular via the washpipe free feature 208. Because the downhole tubular 106 is already plugged from below and the downhole tubular 106 is filled with wellbore fluid via the washpipe free feature 208, the pressure in the downhole tubular 106 may be immediately increased to set the packer assembly once the lower completion assembly 102 is in the desired location in the wellbore 104.

Moreover, the flow regulating system 108 may include a sliding sleeve door 214 disposed in the flow path between the washpipe free feature 208 and the central bore 204 of the downhole tubular 106. The sliding sleeve door 214, also referred to as an SSD sleeve in later figures, may include an open position and a closed position. As the lower completion assembly 102 is run-in-hole, traditional configurations of the sliding sleeve door 214 may generally be set in an open position such that fluid may flow between the annulus 110 and the downhole tubular 106. The sliding sleeve door 214 may be shifted between the open position to the closed position (e.g., to block fluid flow through the flow regulating system 108) using a shifting tool that is lowered downhole to the lower completion assembly 102 via wireline, slickline or coil tubing. The sliding sleeve door 214 may be shifted between the open position and the closed position to control production flow during production operations.

As illustrated, in the run-in position, the washpipe free feature 208 may further include the ball 226 disposed within the nozzle chamber 222. Indeed, in the run-in position, the piston 212 may be configured to prevent the ball 226 from exiting the nozzle chamber 222 and moving into piston chamber 236. As shown, the piston 212 may be secured in the run-in position. The piston 212 may be slidable from the run-in position to an open position. The piston 212 may be slidable at least in part due to a first group of piston seals such as the O-ring 216 disposed about a proximal side of the piston 212 having larger outer diameters (OD) than a second group of piston seals disposed about a distal side of the piston 212 with respect to the nozzle chamber 222. As pressure builds within the nozzle chamber 222 and/or piston chamber 236, a net force may be applied to piston 212 in an axial direction to drive the piston 212 to slide toward the open position. Such pressure and/or fluid flow in the nozzle chamber 222 and/or piston chamber 236 may also drive the ball 226 to move within nozzle chamber 222 in response to fluid flow through nozzle chamber 222. For example, in response to pressuring up the downhole tubular 106, the ball 226 may be driven into a ball seat of the inflow control device nozzle 206. That is, with the ball 226 disposed in the nozzle chamber 222, fluid flowing from the central bore 204 of the downhole tubular 106 toward the annulus 110 may drive the ball 226 into the ball seat. Further, the interface between the ball 226 and the ball seat may block fluid flow through the nozzle chamber 222, which may cause pressure to build in the nozzle chamber 222, the piston chamber 236, and the central bore 204 of the downhole tubular 106.

In response to the pressure reaching a predetermined pressure in the piston chamber 236, the piston 212 may shift from the run-in position to an open position. That is, at the predetermined pressure, the driving force on the piston 212 via the pressure may shear the shear pins 240. In response to the shear pins 240 shearing, the piston 212 may freely move from the run-in position to the open position. In the open position, fluid flowing from annulus 110 toward the central bore 204 of the downhole tubular 106 may drive the ball 226 from the nozzle chamber 222 and into the piston chamber 236. After, the piston 212 may slide toward the open position, and fluid flow from the annulus 110 may cause the ball 226 to traverse out of nozzle chamber 222 and into piston chamber 236, which may allow for unobstructed fluid communication between nozzle chamber 222 and piston chamber 236.

Such fluid flow may also drive the ball 226 toward a magnet disposed within piston chamber 236. The ball 226 may comprise a ferromagnetic material (e.g., ferromagnetic metal) such that the magnet may hold the ball 226 once the ball 226 comes in contact with the magnet. The magnet may be secured to the radially inner surface of piston chamber 236 via at least one fastener (e.g., screw, pin, adhesive). Alternatively, the magnet may be press-fit, welded, or otherwise secured within piston chamber 236. Moreover, the magnet may include any suitable permanent magnet or electromagnet. For example, the magnet may comprise a rare earth metal magnet (e.g., or samarium cobalt, neodymium, etc.), which provides the benefit of maintaining a magnetic field without an external power source. Further, the magnet may be coated or otherwise isolated from the fluid traversing through piston chamber 236. For example, the magnet may comprise a material that is not chemically compatible with the fluids in piston chamber 236. As such, the magnet may be coated or otherwise isolated to prevent undesired chemical reactions between the magnet and the fluid. It should be further noted that a magnet may not be utilized to prevent ball 226 from traversing back to nozzle chamber 222. Alternatively, the ball 226 may disintegrate or a flexible tab may be utilized to prevent ball 226 from traversing back to nozzle chamber 222. This may allow for ball 226 to traverse out of nozzle chamber 222 and prevent ball 226 from traversing back to the nozzle chamber 222.

As illustrated, the washpipe free feature 208 may be in the run-in position and fluid may be flowing from the downhole tubular 106 toward the annulus 110 (e.g., referring to FIG. 1). That is, fluid is flowing from piston chamber 236 toward nozzle chamber 222. As such, the ball 226 may be driven toward the ball seat. Moreover, after the lower completion assembly 102 (shown in FIG. 1) is positioned at a desired location in the wellbore 104 (shown in FIG. 1), the pressure inside the downhole tubular 106 may be increased to the setting pressure for actuating the packer assembly 116 (shown in FIG. 1). However, fluid flowing through nozzle chamber 222 toward the annulus 110 may act as a pressure drop that may increase a needed fluid flow to achieve the setting pressure. As such, preventing fluid flow from nozzle chamber 222 toward the annulus 110, via blocking nozzle chamber 222 with the ball 226, may assist in raising the pressure in the downhole tubular 106 to the setting pressure.

FIG. 2 and at least a portion of FIG. 1 may represent traditional configurations for running in-hole using a packer assembly 116 configured with tubing to annulus pressure sealing. Traditional remotely operated valve (ROV) designs may use an SSD run into the wellbore in the open position, and traditional ROVs may use a check valve to halt flow from the tubing to the annulus but allow flow from the annulus into the tubing. However, traditional configurations may lack effective annulus to tubing pressure sealing for well conditions where kicks may occur during run-in into the wellbore. A modified ROV design, as described in FIGS. 3-7, may allow for annulus-to-tubing sealing. When this modified ROV design and associated components are used in place of FIG. 2's sliding sleeve door 214, the flow regulating system 108 and the modified ROV design described below may enable a packer assembly or other downhole tool to have both tubing-to-annulus and annulus-to-tubing isolation during run-in into a wellbore. One or more ROVs may be used in a single wellbore. The ball and seat configuration of FIG. 2 may be used to ensure that all joints open when actuated to do so.

Example SSD Sleeve and Biasing Piston

Figure 3:
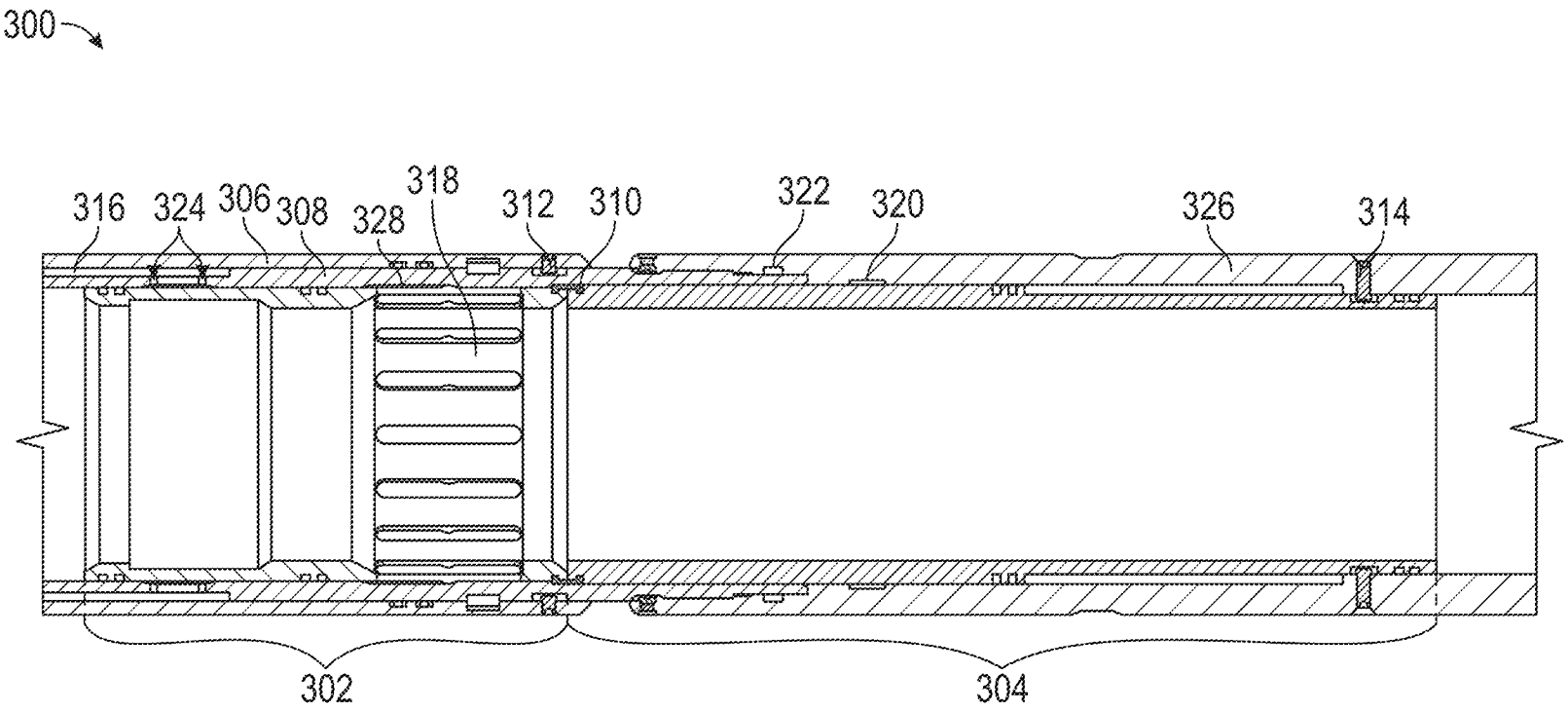
FIG. 3 is a longitudinal section depicting an example sliding side door (SSD) sleeve and biasing piston in the closed position, according to some implementations.

FIG. 3 is a longitudinal section 300 depicting an example SSD and biasing piston in the closed position, according to some implementations. FIG. 3 includes an SSD sleeve 302, a biasing piston 304, a flow shroud 306, an SSD housing 308, a snap ring 310, a set screw 312, a shear screw 314, an annular space 316, a collet 318, a female profile 320, an O-ring 322, flow ports 324, a bottom sub 326, and a recessed portion 328. The SSD sleeve 302 and biasing piston 304 may comprise a remotely operated valve positioned fluidically downstream of the one or more screens 200 of FIG. 2. The one or more screens 200 may be positioned uphole of the ROV including the SSD sleeve 302 and biasing piston 304. Fluid may enter the flow regulating system 108 of FIG. 1 through the one or more screens 200 and the piston chamber 336. Fluid may continue to travel towards the ROV through the annular space 316 formed between the flow shroud 306 and SSD housing 308. The annular space 316 may function as a flow path for fluid entering via the screen 200 and ICD nozzle 206. This fluid flow may enter the central bore 204 of the downhole tubular 106 via the flow ports 324 when the SSD sleeve 302 is in the open position. With regard to the components of FIG. 3, the collet 318 may snap into a recessed portion 328 of the SSD housing 308. The collet 318 may prevent the SSD sleeve 302 from moving or shifting unintentionally (i.e., without the use of a shifting tool).

In contrast to the flow regulating system 108 of FIG. 2, one or more packer assemblies, completion tools, etc. may be ran downhole with the SSD sleeve 302 in the closed position, blocking flow from entering the flow ports 324. The SSD sleeve 302 in the closed position may function as a barrier to prevent fluid annulus-to-tubing fluidic communication if the well kicks.

As shown, the SSD sleeve 302 may be coupled with the biasing piston 304 via the snap ring 310 during run-in into the wellbore. The biasing piston 304 may be locked in place during run-in via the shear screw 314. In some implementations, the shear screw 314 may instead comprise a shear pin or shear ring configured to shear upon exceeding a tubing pressure threshold. For example, the shear screw 314

(or optionally, a shear pin) may shear upon a tubing pressure exceeding a 2,000 pounds per square inch (psi) threshold, a 3,000 psi threshold, etc.

Figure 4:
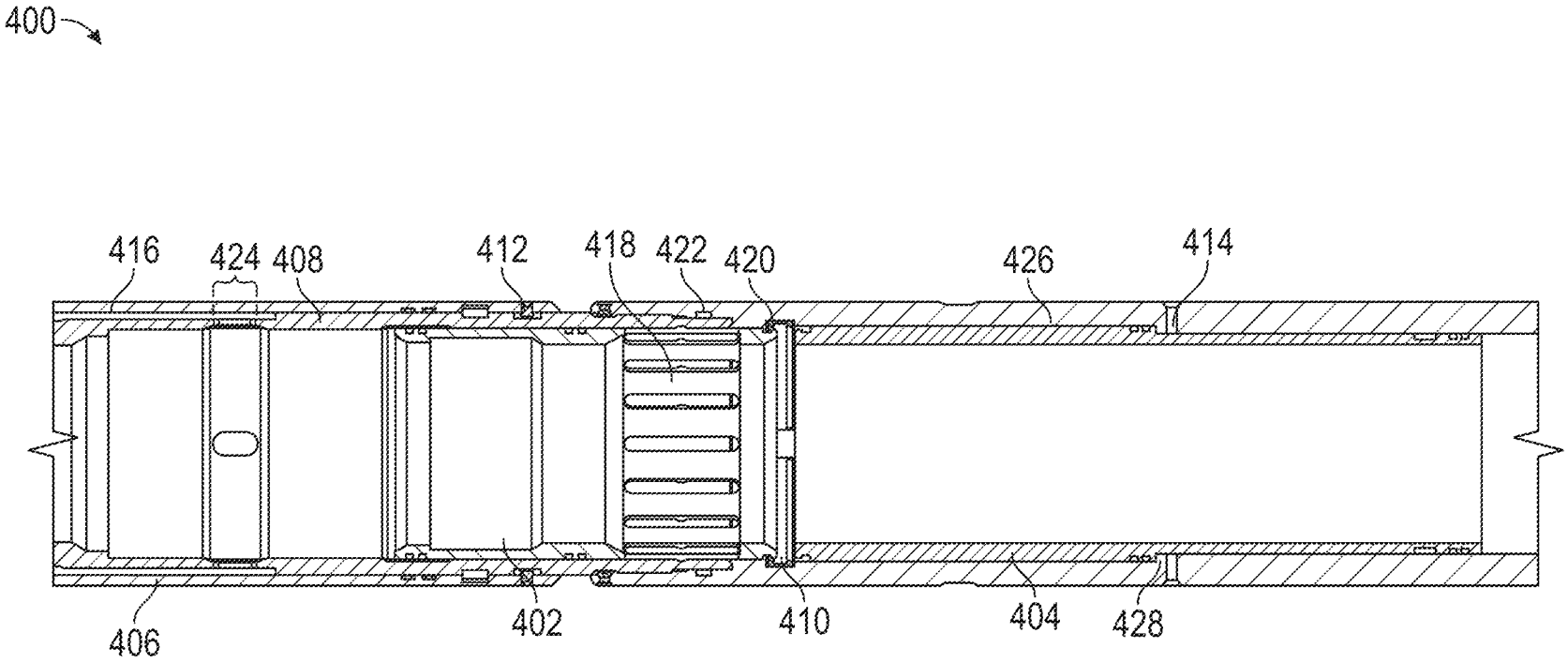
FIG. 4 is a longitudinal section depicting the example SSD sleeve and biasing piston in the open position, according to some implementations.

FIG. 4 is a longitudinal section 400 depicting the example SSD sleeve and biasing piston in the open position, according to some implementations. FIG. 4 includes similar components to those of FIG. 3. For example, FIG. 4 includes the SSD sleeve 402, biasing piston 404, flow shroud 406, SSD housing 408, snap ring 410, set screw 412, a shear screw opening 414, annular space 416, collet 418, female profile 420, O-ring 422, flow ports 424, a bottom sub 426, a shoulder 428, and a recessed portion 430. In FIG. 4, the tubing pressure may be increased to induce movement of the biasing piston 404. The movement of the biasing piston 404 may move the SSD sleeve 402 to the open position. In the open position, ports 424 may allow free fluid communication between the annular space 416 and the tubing.

The shear screw 314 of FIG. 3 may hold the biasing piston 404 in place during run-in. When the well is ready for setting a packer or packer assembly, such as the packer assembly 116, the tubing pressure may be increased. The applied tubing pressure may enable the biasing piston 404 to shear the shear screw 314 upon exceeding a pressure threshold (e.g., 2,000 psi, 3,000 psi, etc.).

Once the shear screw 314 has been sheared, the SSD sleeve 402 and biasing piston 404, coupled via the snap ring 410, may begin moving to the right. The SSD sleeve 402 and biasing piston 404 may move to the right for a first distance until the snap ring 410 has snapped out. In some implementations, the snap ring 410 may snap when a full stroke of the biasing piston 404 has been achieved. A full stroke of the biasing piston 404 may occur when the biasing piston 404 shoulders against a smaller inner diameter (ID) surface such as the shoulder 428, preventing further rightward movement. In such an example where the biasing piston 404 is fully stroked, the snap ring 410 may snap out and expand into the female profile 420 of bottom sub 426, separating the SSD sleeve 402 and biasing piston 404. Once stroked, the biasing piston 404 may be locked in place by the snapped snap ring 410 and the shoulder 428.

The biasing piston 404 may include a varied cross-sectional area across its length which may bias the biasing piston 404 to move when the biasing piston 404 experiences a pressure differential. For example, the biasing piston 404 may be biased in a tubing to annulus configuration, as shown by the thicker piston body on the left half of the biasing piston 404. Thus, the biasing piston 404 may move to the right when the tubing pressure is increased over the annular pressure. Rightward movement of the biasing piston 404 may be halted by the shoulder 428. The biasing piston 404 may also be configured to move left when the annular pressure exceeds the tubing pressure, but the snap ring 410, once snapped into the female profile 420, may halt leftward movement of the biasing piston 404. In some implementations, the biasing piston 404 may instead be biased in a tubing to atmospheric chamber configuration, where the biasing piston 404 is configured to move to the right when the tubing pressure exceeds the pressure of the atmospheric chamber in addition to the pressure required to shear the shear screws. Similarly, the shoulder 428 and snap ring 410 may prevent the movement of the biasing piston 404.

The biasing piston 404 and the snap ring 410 (used to couple the SSD sleeve 402 to the biasing piston 404 during run-in) may enable the SSD sleeve 402 to be operated remotely during an initial opening of the SSD sleeve 402 for production. For example, the SSD sleeve 402 may be conveyed into the wellbore in a closed position which may halt annulus to tubing hydraulic communication. Once conveyed to a target depth, the SSD sleeve 402 may be actuated to the open position without well intervention using a tool conveyed from the surface. Rather, the SSD sleeve 402 may be opened remotely via an increase in tubing pressure. After this initial opening, the SSD sleeve 402 may be closed and/or opened once again using a shifting tool. One or more of the SSD sleeves 402 (as part of one or more ROVs) may be used per wellbore. For example, one SSD sleeve 402 of a first well interval may be shifted to the closed position due to a high water cut (e.g., above 70%), whereas a different SSD sleeve 402 may remain open for continued production.

Figure 5:
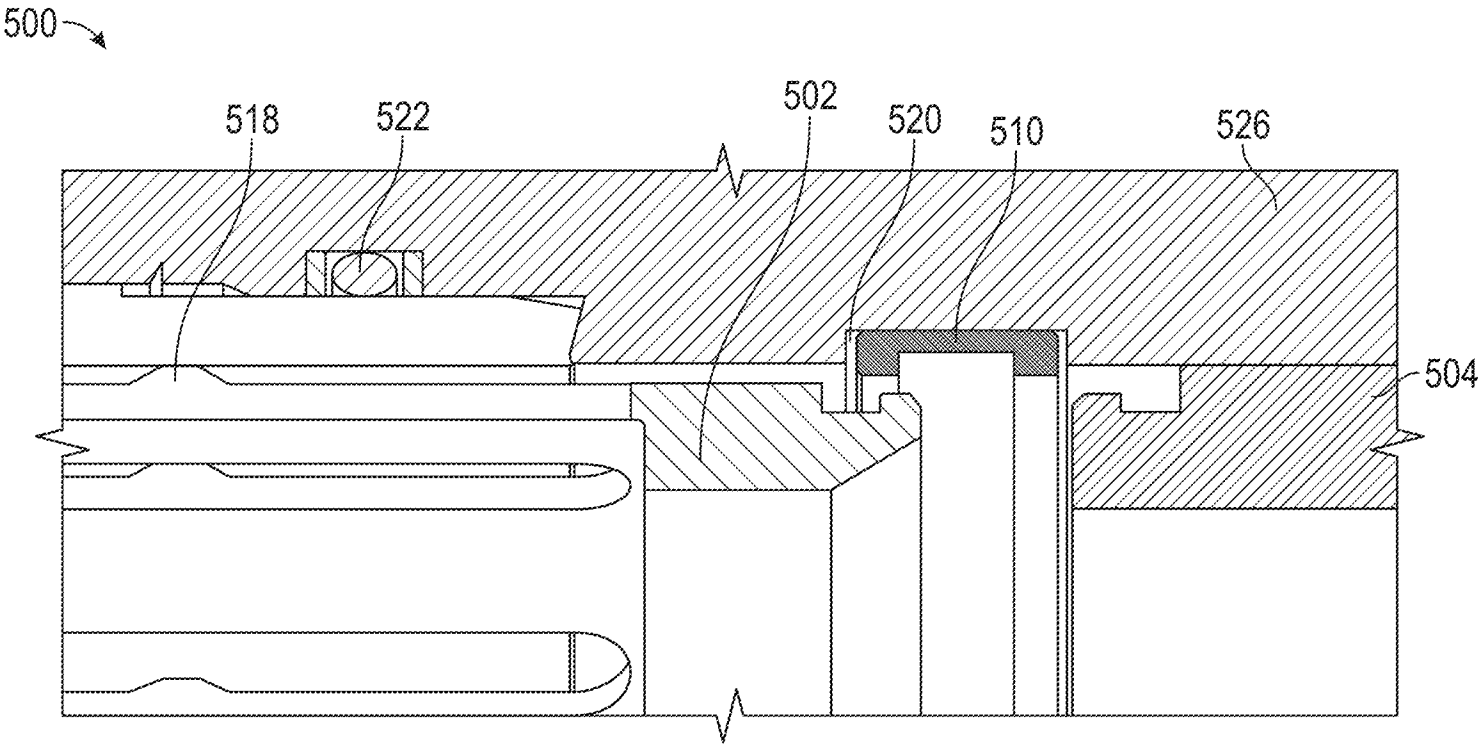
FIG. 5 is a longitudinal section depicting a close-up view of the snap ring once detached from the biasing piston and SSD sleeve, according to some implementations.

FIG. 5 is a longitudinal section 500 depicting a close-up view of the snap ring once detached from the biasing piston and SSD sleeve, according to some implementations. FIG. 5 includes the SSD sleeve 502, the biasing piston 504, the snap ring 510, the collet 518, the female profile 520, the O-ring 522, and the bottom sub 526. The snap ring 510 may serve two primary functions. During run-in, the snap ring 510 may couple the SSD sleeve 502 and biasing piston 504 such that the SSD sleeve 502 moves with the biasing piston 504. Therefore, the SSD sleeve 502 may be biased during run-in but pressure balanced once disconnected from the biasing piston 504.

The second primary function of the snap ring 510 is to hold the biasing piston 504 in place. For example, at least a portion of the snap ring 510 may extend radially beyond the female profile 520 to limit uphole travel of the biasing piston 504. The SSD sleeve 502 may remain pressure balanced. If pressure in the annulus exceeds a pressure within the tubing, the snap ring 510 may prevent the biasing piston 504 from moving to the left and contacting the SSD sleeve 502.

As shown, the snap ring 510 has snapped into the female profile 520, separating the SSD sleeve 502 and biasing piston 504 from one another. While both pieces moved simultaneously during run-in into the well, the SSD sleeve 502 and biasing piston 504 may move independently after the snap ring 510 has snapped.

While FIG. 5 includes the snap ring 510, other devices may also be used to convey the biasing piston 504 and SSD sleeve 502 into the wellbore and decouple upon the application of tubing pressure. In some implementations, any outwardly-biasing component configured for expansion into the female profile 520 may be used in place of the snap ring 510. For example, the snap ring 510 may instead comprise a collet, one or more spring devices, etc.

Figure 6:
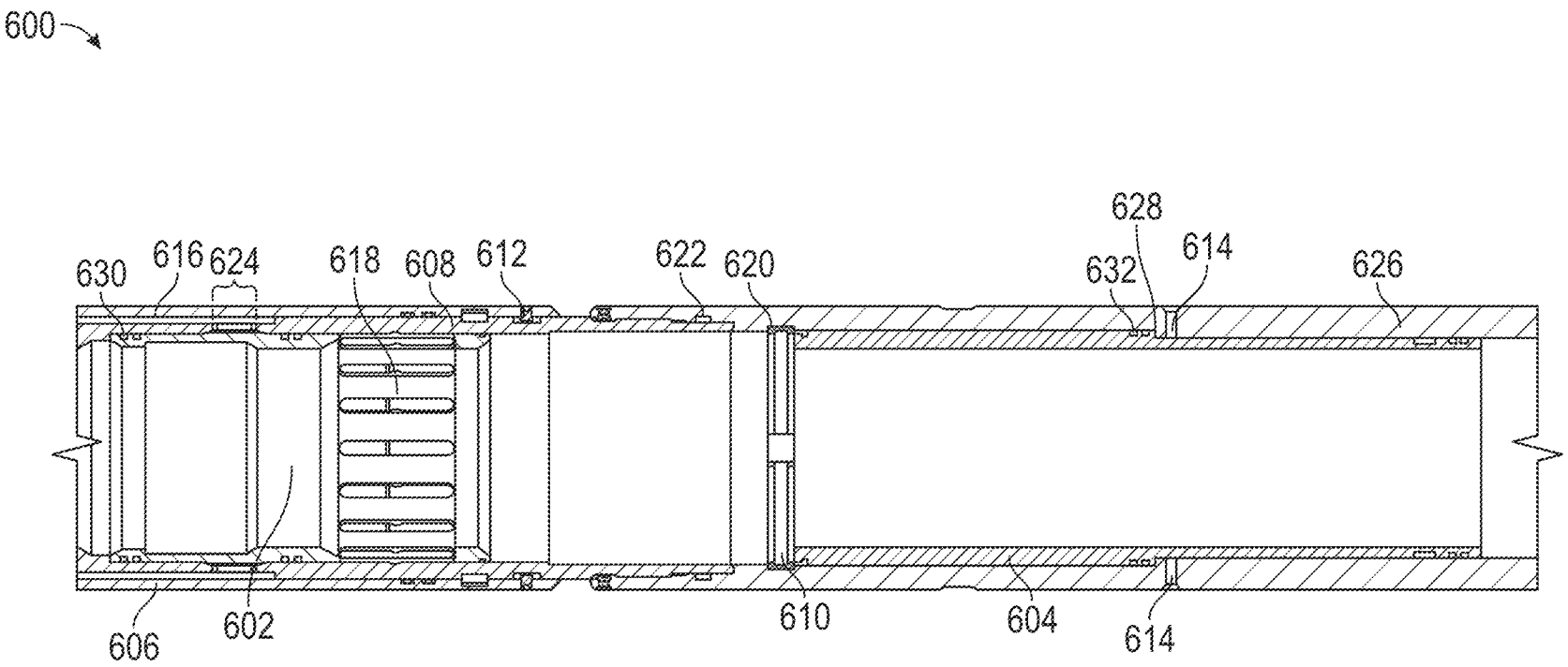
FIG. 6 is a longitudinal section depicting the biasing piston locked in place and the SSD sleeve in the closed position, according to some implementations.

FIG. 6 is a longitudinal section 600 depicting the biasing piston locked in place and the SSD sleeve in the closed position, according to some implementations. FIG. 6 includes the SSD sleeve 602, the biasing piston 604, the flow shroud 606, the SSD housing 608, the snap ring 610, the set screw 612, the shear screw opening 614, the annular space 616, the collet 618, the female profile 620, the O-ring 622, the flow ports 624, the bottom sub 626, the shoulder 628, an SSD O-ring 630, and one or more biasing piston O-rings 632. As shown, the SSD sleeve 602 may be closed by a shifting tool after being remotely opened via the application of tubing pressure and the biasing piston 604. In the closed position, the SSD sleeve 602 may block flow from the flow ports 624, and the SSD O-rings may prevent fluid from entering the tubing. Accordingly, the snap ring 610 may prevent the biasing piston 604 from moving to the left (uphole), isolating any weep hole (not shown) and shear screw opening(s) 614. Weep holes may be included in the bottom sub 626 to allow fluid between the bottom sub 626 and the biasing piston O-rings 632, O-ring 622, etc. to escape to the tubing annulus when the biasing piston 604 is moved to the right.

Example Method of Operations

Figure 7:
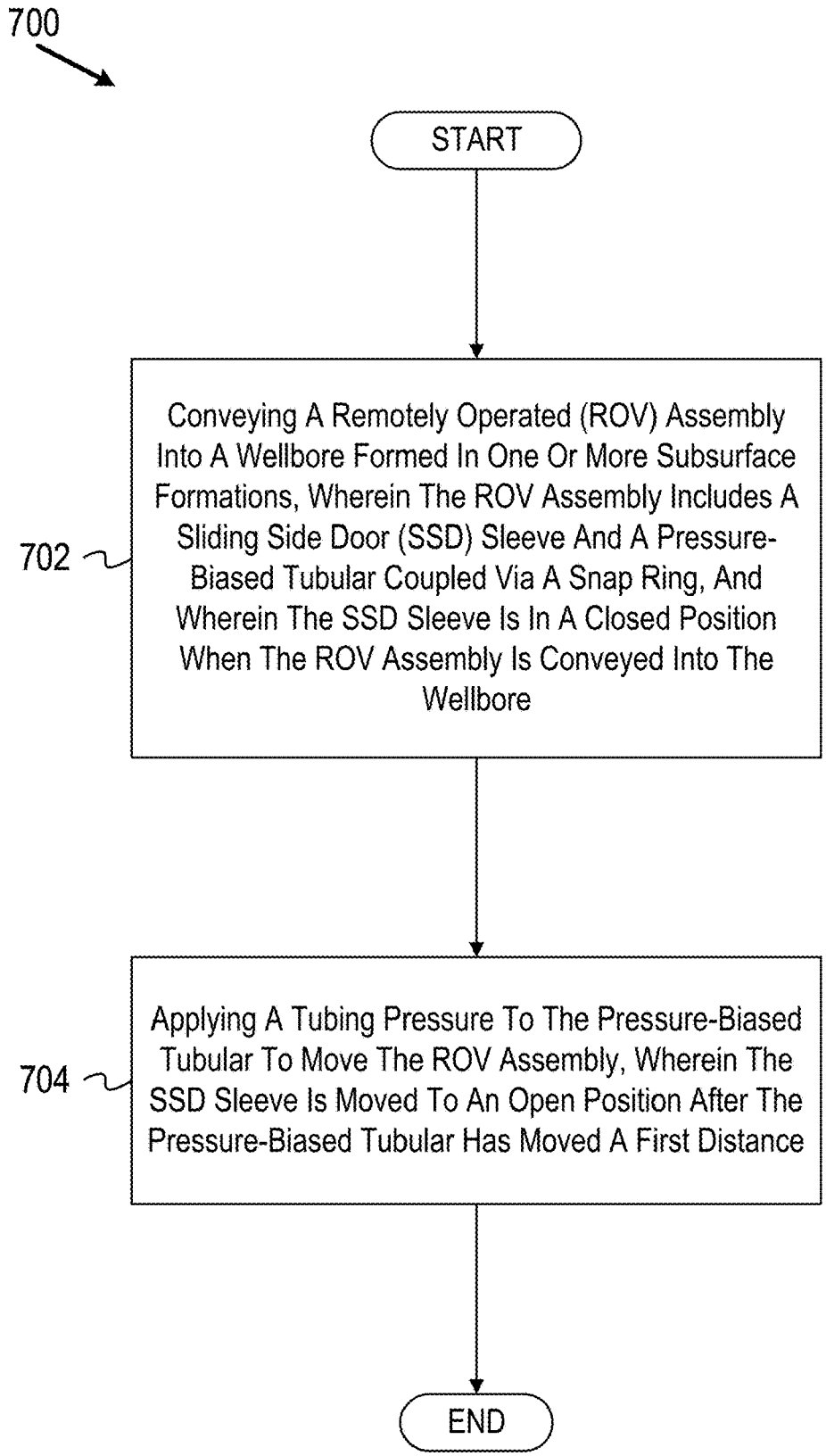
FIG. 7 is a flowchart depicting an example method of operations, according to some implementations.

FIG. 7 is a flowchart depicting an example method of operations, according to some implementations. Operations of a method 700 may be performed by software, firmware, hardware, or a combination thereof. Such operations are described with reference to FIGS. 1-6. However, such operations may be performed by other systems or components. The operations of the method 700 begin at block 702. through one or more At block 702, the method 700 includes conveying a remotely operated valve (ROV) assembly into a wellbore formed in one or more subsurface formations, wherein the ROV assembly includes a sliding side door (SSD) sleeve and a pressure-biased tubular coupled via a snap ring, and wherein the SSD sleeve is in a closed position when the ROV assembly is conveyed into the wellbore. For example, an ROV assembly may include the SSD sleeve 302, biasing piston 304, and snap ring 310. The SSD sleeve 302 may be conveyed into a wellbore in the closed position to provide an annulus-to-tubing seal against wellbore fluids, kicks, etc. The SSD sleeve 302 may be coupled to the biasing piston 304 via at least one snap ring such as the snap ring 310 such that movement of the biasing piston 304 (e.g., from a pressure differential) also moves the SSD sleeve 302. Flow progresses to block 704.

At block 704, the method 700 includes applying a tubing pressure to the pressure-biased tubular to move the ROV assembly, wherein the SSD sleeve is moved to an open position after the pressure-biased tubular has moved a first distance. With reference to FIG. 4, the SSD sleeve 402 may be remotely moved to the open position via movement of the biasing piston 404 to which it is coupled. The biasing piston 404 may move after a tubing pressure threshold has been met, in which the shear screws 314 are sheared. The biasing piston 404 and SSD sleeve 402 may move a first lateral distance until the two components are decoupled by the snapped snap ring 410. In some implementations, the first lateral distance may refer to the point in which the biasing piston 404 contacts the shoulder 428. When the snap ring 410 has snapped into the female profile 420, lateral movement of the biasing piston may be limited by the snap ring 410 and the shoulder 428. Flow of the method 700 ceases.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub-combination. Moreover, although features may be described as acting in certain combinations and even initially claimed as such, one or more features from a claimed combination may in some cases be excised from the combination, and the claimed combination may be directed to a sub-combination or variation of a sub-combination.

While operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed. Similarly, "at least one of: a, b, or c" is intended to cover: a, b, c, a-b, a-c, b-c, and a-b-c.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well may be horizontal or even slightly directed upwards. Unless otherwise specified, use of the terms "subsurface formation" or "subterranean formation" shall be construed as encompassing both areas below exposed earth and areas below earth covered by water such as ocean or fresh water.

EXAMPLE IMPLEMENTATIONS

Example implementations include the following:

Implementation #1: A system configured for use in a wellbore drilled through one or more subsurface formations, the system comprising: a tubing string comprising one or more tubulars; a sliding side door (SSD) sleeve configured to move between an open position and a closed position; at least one snap ring; and a pressure-biased tubular, wherein the pressure-biased tubular and the SSD sleeve are coupled via the at least one snap ring.

Implementation #2: The system of Implementation 1, further comprising: one or more shear screws, wherein the one or more shear screws hold the pressure-biased tubular in place when conveyed into the wellbore, and wherein the one or more shear screws are configured to shear when a tubing pressure threshold is reached.

Implementation #3: The system of any one or more of Implementations 1-2, wherein the pressure-biased tubular and the SSD sleeve are coupled via the at least one snap ring when conveyed into the wellbore, wherein the SSD sleeve is in the closed position when conveyed into the wellbore, and wherein the SSD sleeve in the closed position prevents a first fluid in an annulus external to the tubing string from entering an interior of the tubing string.

Implementation #4: The system of any one or more of Implementations 1-3, wherein a first portion of the pressure-biased tubular includes a larger cross-sectional area than a second portion of the pressure-biased tubular, and wherein the pressure-biased tubular is configured to move via a pressure differential between the annulus and the interior of the tubing string.

Implementation #5: The system of any one or more of Implementations 1-4, wherein the pressure-biased tubular is configured to move when an application of tubing pressure exceeds an annular pressure of the annulus, wherein the movement of the pressure-biased tubular is halted, at least in part, by a shoulder, and wherein the at least one snap ring and SSD sleeve are configured to move with the pressure-biased tubular.

Implementation #6: The system of any one or more of Implementations 1-5, wherein the SSD sleeve is moved to the open position when the pressure-biased tubular has moved a first distance, wherein the at least one snap ring is configured to snap into a female profile after the pressure-biased tubular has moved the first distance, and wherein the SSD sleeve and pressure-biased tubular are configured to separate when the at least one snap ring has snapped into the female profile.

Implementation #7: The system of any one or more of Implementations 1-6, wherein at least a portion of the at least one snap ring is configured to hold the pressure-biased tubular in place after the at least one snap ring has snapped into the female profile.

Implementation #8: An apparatus configured for use in a wellbore formed in one or more subsurface formations, the apparatus comprising: a sliding side door (SSD) sleeve configured to move between an open position and a closed position; at least one snap ring; and a pressure-biased tubular, wherein the pressure-biased tubular and the SSD sleeve are coupled via the at least one snap ring.

Implementation #9: The apparatus of Implementation 8, further comprising: one or more shear screws, wherein the one or more shear screws hold the pressure-biased tubular in place when conveyed into the wellbore, and wherein the one or more shear screws are configured to shear when a tubing pressure threshold is reached.

Implementation #10: The apparatus of any one or more of Implementations 8-9, wherein the pressure-biased tubular and the SSD sleeve are coupled via the at least one snap ring when conveyed into the wellbore, wherein the SSD sleeve is in the closed position when conveyed into the wellbore, and wherein the SSD sleeve in the closed position prevents a first fluid in an annulus external to a tubing string from entering an interior of the tubing string, wherein the tubing string includes one or more tubulars.

Implementation #11: The apparatus of any one or more of Implementations 8-10, wherein a first portion of the pressure-biased tubular includes a larger cross-sectional area than a second portion of the pressure-biased tubular, and wherein the pressure-biased tubular is configured to move via a pressure differential between the annulus and the interior of the tubing string.

Implementation #12: The apparatus of any one or more of Implementations 8-11, wherein the pressure-biased tubular is configured to move when an application of tubing pressure exceeds an annular pressure of the annulus, wherein the movement of the pressure-biased tubular is halted, at least in part, by a shoulder, and wherein the at least one snap ring and SSD sleeve are configured to move with the pressure-biased tubular.

Implementation #13: The apparatus of any one or more of Implementations 8-12, wherein the SSD sleeve is moved to the open position when the pressure-biased tubular has moved a first distance, wherein the at least one snap ring is configured to snap into a female profile after the pressure-biased tubular has moved the first distance, wherein the SSD sleeve and pressure-biased tubular are configured to separate when the at least one snap ring has snapped into the female profile.

Implementation #14: The apparatus of any one or more of Implementations 8-13, wherein at least a portion of the at least one snap ring is configured to hold the pressure-biased tubular in place after the at least one snap ring has snapped into the female profile.

Implementation #15: A method comprising: conveying a remotely operated valve (ROV) assembly into a wellbore formed in one or more subsurface formations, wherein the ROV assembly includes a sliding side door (SSD) sleeve and a pressure-biased tubular coupled via at least one snap ring, and wherein the SSD sleeve is in a closed position when the ROV assembly is conveyed into the wellbore; and applying a tubing pressure to the pressure-biased tubular to move the ROV assembly, wherein the SSD sleeve is moved to an open position after the pressure-biased tubular has moved a first distance.

Implementation #16: The method of Implementation 15, wherein the SSD sleeve in the closed position forms an annulus-to-tubing seal between a tubing string including one or more tubulars and an annulus external to the tubing string, and wherein the annulus-to-tubing seal prevents a fluid in the annulus from entering the tubing string.

Implementation #17: The method of any one or more of Implementations 15-16, wherein a first portion of the pressure-biased tubular includes a larger cross-sectional area than a second portion of the pressure-biased tubular, and wherein the larger cross-sectional area biases the pressure-biased tubular to move via a pressure differential between the annulus and an interior of the tubing string.

Implementation #18: The method of any one or more of Implementations 15-17, wherein applying the tubing pressure to the pressure-biased tubular comprises exceeding a tubing pressure threshold, wherein the ROV assembly includes one or more shear screws, and wherein the one or more shear screws are configured to hold the pressure-biased tubular in place when the ROV assembly is conveyed into the wellbore.

Implementation #19: The method of any one or more of Implementations 15-18, further comprising: shearing the one or more shear screws when the applied tubing pressure exceeds the tubing pressure threshold; moving, via the applied tubing pressure, the pressure-biased tubular and the SSD sleeve; and decoupling the pressure-biased tubular and the SSD sleeve after the pressure-biased tubular has moved the first distance.

Implementation #20: The method of any one or more of Implementations 15-19, wherein decoupling the pressure-biased tubular and the SSD sleeve comprises: snapping the at least one snap ring into a female profile, wherein the snapped at least one snap ring separates the SSD sleeve from the pressure-biased tubular, and wherein the movement of the pressure-biased tubular is halted, at least in part, by a shoulder and the snapped at least one snap ring.

What is claimed is:

1. A system configured for use in a wellbore drilled through one or more subsurface formations, the system comprising:

a tubing string comprising one or more tubulars, wherein an annulus exists between the tubing string and the wellbore;

a sliding sleeve configured to move between an open position and a closed position;

a biasing piston configured to move between an open position and a run-in position; and a snap ring configured to selectively couple the sliding sleeve and the biasing piston, wherein the snap ring is configured to couple the biasing piston in the run-in position to the sliding sleeve, and wherein the biasing piston and the sliding sleeve are configured to decouple from the snap ring when the biasing piston is in the open position.

2. The system of claim 1, further comprising:

one or more shear screws, wherein the one or more shear screws are configured to hold the biasing piston a in the run-in position during conveyance to a first depth in the wellbore, and wherein the one or more shear screws are configured to shear when a tubing pressure threshold is reached.

3. The system of claim 1, wherein the biasing piston and the sliding sleeve are configured to be coupled via the snap ring during conveyance to a first depth in the wellbore, wherein the sliding sleeve is configured to remain in the closed position during the conveyance to the first depth, and wherein the sliding sleeve in the closed position is configured to prevent a first fluid in the annulus from entering an interior of the tubing string.

4. The system of claim 1, wherein a first portion of the biasing piston includes a larger cross-sectional area than a second portion of the biasing piston, and wherein the biasing piston is configured to move via a pressure differential between the annulus and an interior of the tubing string.

5. The system of claim 1, further comprising:

a shoulder configured to limit an axial travel of the biasing piston from the run-in position to the open position, wherein the biasing piston is configured to move when an application of tubing pressure exceeds an annular pressure of the annulus, and wherein the snap ring and the sliding sleeve are configured to move with the biasing piston from the run-in position to the open position.

6. The system of claim 1, further comprising:

a female profile configured to receive the snap ring, wherein the biasing piston and the sliding sleeve are configured to move a first axial distance, wherein the snap ring is configured to snap into the female profile after the biasing piston has moved the first axial distance, and wherein the sliding sleeve and the biasing piston are configured to separate when the snap ring has snapped into the female profile.

7. The system of claim 6, wherein at least a portion of the snap ring is configured to limit an uphole travel of the biasing piston after the snap ring has snapped into the female profile.

8. An apparatus configured for use in a wellbore formed in one or more subsurface formations, the apparatus comprising:

a sliding sleeve configured to move between an open position and a closed position;

a biasing piston configured to move between an open position and a run-in position; and a snap ring configured to selectively couple the sliding sleeve and the biasing piston, wherein the snap ring is configured to couple the biasing piston in the run-in position to the sliding sleeve, and wherein the biasing piston and the sliding sleeve are configured to decouple from the snap ring when the biasing piston is in the open position.

9. The apparatus of claim 8, further comprising:

one or more shear screws, wherein the one or more shear screws are configured to hold the biasing piston in the run-in position during conveyance to a first depth in the wellbore, and wherein the one or more shear screws are configured to shear when a tubing pressure threshold is reached.

10. The apparatus of claim 8, wherein the biasing piston and the sliding sleeve are configured to be coupled via the snap ring during conveyance to a first depth in the wellbore, wherein the sliding sleeve is configured to remain in the closed position during the conveyance to the first depth, and wherein the sliding sleeve in the closed position is configured to prevent a first fluid in an annulus external to a tubing string from entering an interior of the tubing string, wherein the tubing string includes one or more tubulars.

11. The apparatus of claim 10, wherein a first portion of the biasing piston includes a larger cross-sectional area than a second portion of the biasing piston, and wherein the biasing piston is configured to move via a pressure differential between the annulus and the interior of the tubing string.

12. The apparatus of claim 10, further comprising:

a shoulder configured to limit an axial travel of the biasing piston from the run-in position to the open position, wherein the pressure biasing piston is configured to move when an application of tubing pressure exceeds an annular pressure of the annulus, and wherein the snap ring and sliding sleeve are configured to move with the biasing piston from the run-in position to the open position.

13. The apparatus of claim 8, further comprising:

a female profile configured to receive the snap ring, wherein the biasing piston and the sliding sleeve are configured to move a first axial distance, wherein the snap ring is configured to snap into the female profile after the biasing piston has moved the first axial distance, and wherein the sliding sleeve and the biasing piston are configured to separate when the snap ring has snapped into the female profile.

14. The apparatus of claim 13, wherein at least a portion of the snap ring is configured to limit an uphole travel of the biasing piston after the snap ring has snapped into the female profile.

15. A method comprising:

conveying a remotely operated valve (ROV) assembly into a wellbore formed in one or more subsurface formations, wherein the ROV assembly includes a sliding sleeve and a biasing piston selectively coupled via a snap ring, and wherein the sliding sleeve is in a closed position when the ROV assembly is conveyed into the wellbore;

applying a tubing pressure to the biasing piston to move the ROV assembly, wherein the sliding sleeve is moved to an open position after the biasing piston has moved a first axial distance; and decoupling, via the snap ring, the biasing piston from the sliding sleeve after the biasing piston has moved the first axial distance.

16. The method of claim 15, wherein the ROV assembly is coupled to a tubing string including one or more tubulars, wherein the sliding sleeve in the closed position forms an annulus-to-tubing seal between the tubing string and an annulus formed between the tubing string and the wellbore, and wherein the annulus-to-tubing seal prevents a fluid in the annulus from entering the tubing string.

17. The method of claim 16, wherein a first portion of the biasing piston includes a larger cross-sectional area than a second portion of the biasing piston, and wherein the larger cross-sectional area biases the biasing piston to move via a pressure differential between the annulus and an interior of the tubing string.

18. The method of claim 15, wherein the ROV assembly includes one or more shear screws, wherein the biasing piston is configured to move between a closed position and a run-in position, and wherein the one or more shear screws are configured to hold the pressure biasing piston in the run-in position when the ROV assembly is conveyed into the wellbore.

19. The method of claim 18, further comprising:

applying a tubing pressure such that the applied tubing pressure exceeds a tubing pressure threshold;

shearing the one or more shear screws when the applied tubing pressure has exceeded the tubing pressure threshold; and moving, via the applied tubing pressure, the biasing piston and the sliding sleeve the first axial distance.

20. The method of claim 15, wherein decoupling the biasing piston from the sliding sleeve comprises:

snapping the snap ring into a female profile of the ROV assembly, wherein the snapped snap ring separates the sliding sleeve from the biasing piston, and wherein a movement of the biasing piston is halted, at least in part, by a shoulder and the snapped snap ring.

* * * * *